US010126104B2

(12) United States Patent
Dumont

(10) Patent No.: US 10,126,104 B2
(45) Date of Patent: Nov. 13, 2018

(54) CARTRIDGE AMMUNITION

(71) Applicant: ATLANTIS SPECIALIST TECHNOLOGIES PROPRIETARY LIMITED, Cape Town (ZA)

(72) Inventor: Terence Paul Dumont, Cape Town (ZA)

(73) Assignee: Atlantis Specialist Technologies Proprietary Limited, Bellville (ZA)

( * ) Notice: Subject to any disclaimer, the term of this patent is extended or adjusted under 35 U.S.C. 154(b) by 0 days.

(21) Appl. No.: 15/752,097

(22) PCT Filed: Jul. 28, 2016

(86) PCT No.: PCT/IB2016/054510
§ 371 (c)(1),
(2) Date: Feb. 12, 2018

(87) PCT Pub. No.: WO2017/033072
PCT Pub. Date: Mar. 2, 2017

(65) Prior Publication Data

US 2018/0238665 A1 Aug. 23, 2018

(30) Foreign Application Priority Data

Aug. 26, 2015 (ZA) ..... 2015/06248

(51) Int. Cl.
*F42B 10/00* (2006.01)
*F42B 5/26* (2006.01)
(Continued)

(52) U.S. Cl.
CPC ..... *F42B 5/26* (2013.01); *F42B 5/02* (2013.01); *F42C 19/083* (2013.01); *F42C 19/0826* (2013.01)

(58) Field of Classification Search
USPC ..... 102/430, 443, 439
See application file for complete search history.

(56) References Cited

U.S. PATENT DOCUMENTS 4,938,146 A * 7/1990 Gunther ..... F42B 5/067 102/430
5,936,189 A 8/1999 Lubbers
(Continued)

FOREIGN PATENT DOCUMENTS

DE 195 27 621 A1 1/1997
DE 10 2007 039 532 A1 2/2009
(Continued)

OTHER PUBLICATIONS

International Search Report, International Application No. PCT/IB2016/054510, dated Oct. 28, 2016, 4 pp.
(Continued)

*Primary Examiner* — J. Woodrow Eldred
(74) *Attorney, Agent, or Firm* — Myers Bigel, P.A.

(57) ABSTRACT

Cartridge ammunition (10) including a projectile (12) and a cartridge case (14). The cartridge includes a primer chamber (26) located adjacent a base wall (24) for holding a primer (28), a high pressure chamber (30) for holding a propellant charge (32), an intermediate pressure chamber (34) which surrounds the high pressure chamber, for receiving expanding propellant gases from the high pressure chamber and a low pressure chamber (36) at a rear end of the projectile for receiving expanding propellant gases from the intermediate pressure chamber. The pressure chambers are delimited by walls defining venting hole through which expanding gases can flow. The three pressure chambers provide for controlled release of gas pressure resulting in attenuation of peak gas pressures within the cartridge.

19 Claims, 6 Drawing Sheets

(51) Int. Cl.
*F42B 5/02* (2006.01)
*F42C 19/08* (2006.01)

(56) References Cited

U.S. PATENT DOCUMENTS

| | | | |
|---|---|---|---|
| 2002/0195017 | A1 | 12/2002 | Priimak |
| 2011/0290143 | A1 | 12/2011 | Heitmann et al. |

FOREIGN PATENT DOCUMENTS

| | | | |
|---|---|---|---|
| EP | 0 580 017 | A1 | 1/1994 |
| WO | WO 01/71274 | A1 | 9/2001 |
| WO | WO 2014/203215 | A1 | 12/2014 |

OTHER PUBLICATIONS

Written Opinion of the International Searching Authority, International Application No. PCT/IB2016/054510, dated Oct. 28, 2016, 5 pp.

* cited by examiner

CARTRIDGE AMMUNITION

RELATED APPLICATIONS

This application is a 35 U.S.C. § 371 national stage application of PCT Application No. PCT/IB2016/054510, filed on Jul. 28, 2016, which claims priority from South African Application No. 2015/06248 filed on Aug. 26, 2015, the contents of which are incorporated herein by reference in their entireties. The above-referenced PCT International Application was published in the English language as International Publication No. WO 2017/033072 A1 on Mar. 2, 2017.

FIELD OF INVENTION

This invention relates to cartridge ammunition, in particular, subsonic ammunition such as small to medium calibre ammunition.

BACKGROUND TO INVENTION

Known subsonic cartridge ammunition typically includes a projectile and a high-pressure, low-pressure propulsion system for expelling the projectile from the cartridge case. The high-pressure, low-pressure propulsion system comprises a high pressure chamber in the base of the cartridge case which houses a propelling charge and a low pressure chamber surrounding the high pressure chamber. The high pressure chamber has one or more vent openings leading into the low pressure chamber, for expanding propellant gases.

Subsonic cartridge ammunition of the abovementioned type is known to suffer from a number of limitations, including that the propelling charge is often not combusted completely within the high pressure chamber resulting in uncombusted propellant being expelled from the high pressure chamber into the low pressure chamber. A portion of the uncombusted propellant is combusted in the low pressure chamber. However, this has little or no significant propulsion effect on the projectile. A further portion of the uncombusted propellant is wasted as it is discharged along the barrel of the firing weapon.

The Applicant has found that in addition to combustion of propellant in such dual chamber ammunition being inefficient, the amount of the propelling charge which is combusted in the high pressure is inconsistent in such dual chamber cartridge ammunition. Inconsistent combustion of propellant in such dual chamber cartridge ammunition results in inconsistent propellant gas pressures and as a consequence, inconsistent muzzle velocities of projectiles resulting in inaccurate firing. Furthermore, it is not possible to achieve a satisfactory level of control over pressures exerted on the barrels of weapons firing such ammunition, particularly if the cartridge ammunition has been modified so as to achieve an extended range capability.

Generally accepted design criteria used in the design of small to medium calibre subsonic ammunition, include the design of the projectile such that a portion of the projectile which is located within the cartridge case of the ammunition, occupies a minimal volume within the cartridge case so as to provide for maximum internal free volume for expanding propellant gases. It will be appreciated that a reduction in the internal free volume within the cartridge case will result in an increase in gas pressure within the free volume. A relatively large free volume within the cartridge thus acts as a pressure attenuator for propellant gas pressure peaks within the cartridge case. Exposure of weapon chambers to high pressure peaks is clearly unsatisfactory as such exposure may cause damage to the firing weapon and also result in possible injury or death to operators of a firing weapon.

As evidence of the abovementioned design criteria, weapon manufacturers are generally unwilling to endorse the use of enhanced ammunition configurations on their weapons where such enhancements may include, for example, heavier projectiles or extended firing ranges, as the potential for failure is too high due to resultant peak weapon chamber pressures in excess of standard pressures which the weapons were designed to endure in the field.

It is an object of the present invention to ameliorate the abovementioned limitations of known conventional cartridge ammunition.

It is a further object of the present invention to provide cartridge ammunition which meets the abovementioned design criteria and more specifically, which provides for attenuation of high pressure peaks in the weapon chambers of firing weapons.

SUMMARY OF INVENTION

According to the invention there is provided cartridge ammunition including:

a projectile;

a cartridge including:

a) a cartridge case having a cylindrical sidewall having an open front end to which the projectile is attached and a base wall extending across the sidewall at a rear end of the cartridge case;

b) a primer chamber adjacent the base wall in which an initiating primer is held and into which a firing pin of a firing weapon extends for initiating the primer;

c) a high pressure chamber for holding a propellant charge, which is adjacent to and in communication with the primer chamber; and d) an intermediate pressure chamber for receiving expanding propellant gases from the high pressure chamber;

e) a low pressure chamber at an operative rear end of the projectile, for receiving expanding propellant gases from the intermediate pressure chamber, the pressure chambers being delimited by walls within the cartridge case which define at least one high pressure venting hole for expanding propellant gases between the high pressure chamber and the intermediate pressure chamber and at least one intermediate pressure venting hole for expanding propellant gases between the intermediate pressure chamber and the low pressure chamber.

The high pressure chamber may be centrally located within the cartridge case.

The intermediate pressure chamber may have an annular configuration wherein the intermediate pressure chamber surrounds the high pressure chamber when viewed in cross section.

The high pressure chamber may have an elongate cylindrical configuration wherein a longitudinal chamber axis defined by the high pressure chamber coincides with a longitudinal cartridge axis defined by the cartridge case which extends along a centre line of the cartridge case between its front and rear ends.

The cartridge may include a high pressure chamber body insert which defines a boundary between the high pressure chamber and the intermediate pressure chamber and which has a proximal screw thread formation which is sealingly screw-threadingly engaged with a complementary screw thread formation of the base wall of the cartridge case. More specifically, the high pressure chamber body insert may have a hollow cylindrical configuration with a distal end thereof being open.

The high pressure chamber body insert may include a radially-extending annular flange which defines a boundary between the intermediate and low pressure chambers, the flange having a cylindrical outer edge defining an external screw thread formation which is screw-threadingly engaged with a complementary internal screw thread formation of the side wall of the cartridge case.

The cartridge ammunition may include a cap insert which sealingly closes off the distal end of the high pressure chamber body insert and defines a boundary between the high pressure chamber and the low pressure chamber, the cap insert having a cylindrical outer edge defining an external screw thread formation which is screw-threadingly engaged with a complementary internal screw thread formation of the high pressure chamber body insert a the distal end thereof.

The high pressure chamber body insert may define a number of the high pressure venting holes which extend radially outwardly between the high pressure and intermediate pressure chambers allowing for venting of propellant gases from the high pressure chamber to the intermediate pressure chamber.

The cartridge ammunition may include one or more rupturable burst membranes which cover the high pressure venting holes.

The flange of the high pressure chamber body insert may define a number of the intermediate pressure venting holes which extend between the intermediate pressure chamber and the low pressure chamber for venting of propellant gases from the intermediate pressure chamber to the low pressure chamber.

The projectile may include a projectile body having a front end and a rear end which is sealingly located within the front end of the cartridge case, the projectile defining a circumferential skirt formation at a rear end thereof which projects rearwardly from the projectile body and which includes sealing means for forming a gas-tight seal with the sidewall of the cartridge case.

The projectile may include an annular seal which extends circumferentially around the projectile for forming a gas-tight seal with the sidewall of the cartridge case.

The annular seal may be located along an external side of the skirt formation of the projectile.

The external side of the skirt formation may define an annular groove providing a seat within which the annular seal is located.

The projectile may include an additional annular seal which extends circumferentially around the projectile body for forming an additional gas-tight seal with the sidewall of the cartridge case.

The additional annular seal may be located along an external side of the projectile body at a location longitudinally spaced from the annular seal and extending parallel to the annular seal.

The external side of the projectile body may define an annular groove defining a seat within which the additional annular seal is located.

The projectile body may define an annular recess into which a front end region of the cartridge case is crimped inwardly so as to engage the projectile body within the annular recess.

The annular groove for the additional annular seal may be defined within the annular recess.

BRIEF DESCRIPTION OF THE DRAWINGS

Further features of the invention are described hereinafter by way of a non-limiting example of the invention, with reference to and as illustrated in the accompanying diagrammatic drawings. In the drawings.

DETAILED DESCRIPTION OF THE DRAWINGS

Figure 1:
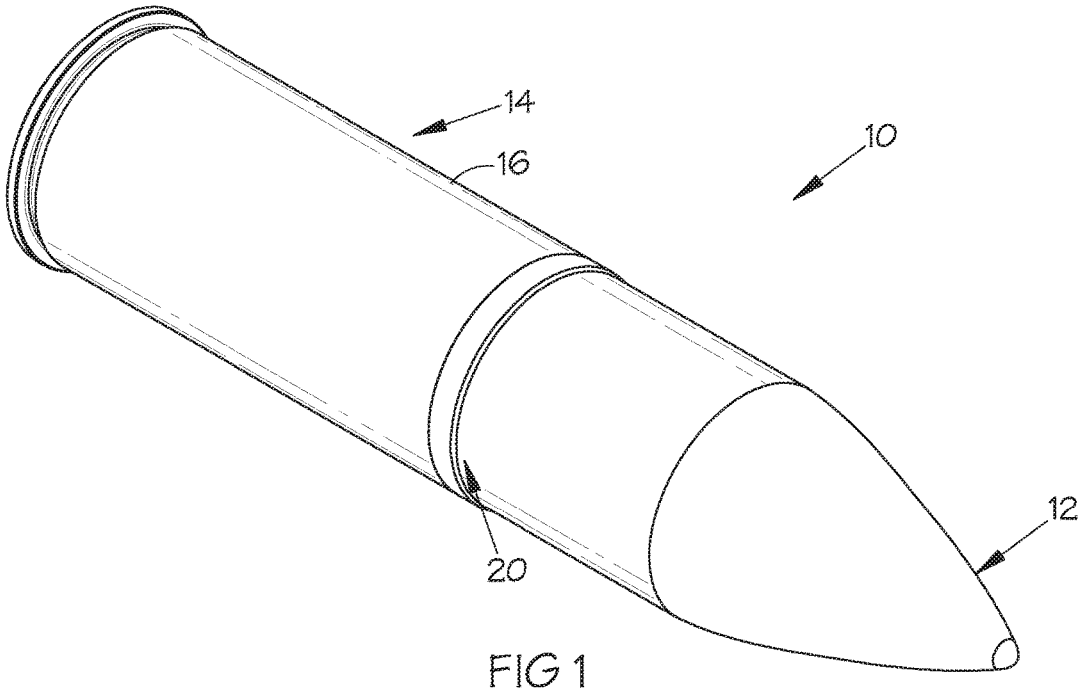
FIG. 1 shows a three-dimensional view of cartridge ammunition in accordance with the invention.
Figure 2:
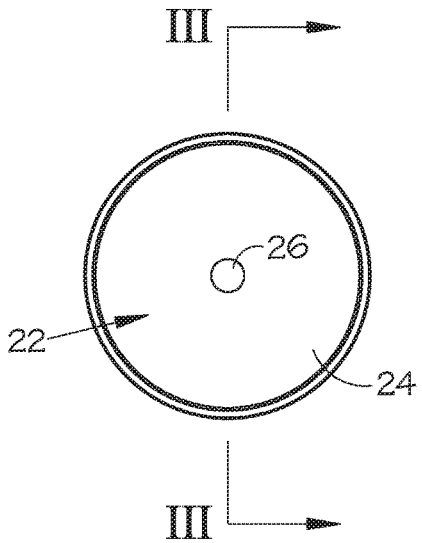
FIG. 2 shows a rear end view of the cartridge ammunition of FIG. 1.
Figure 3:
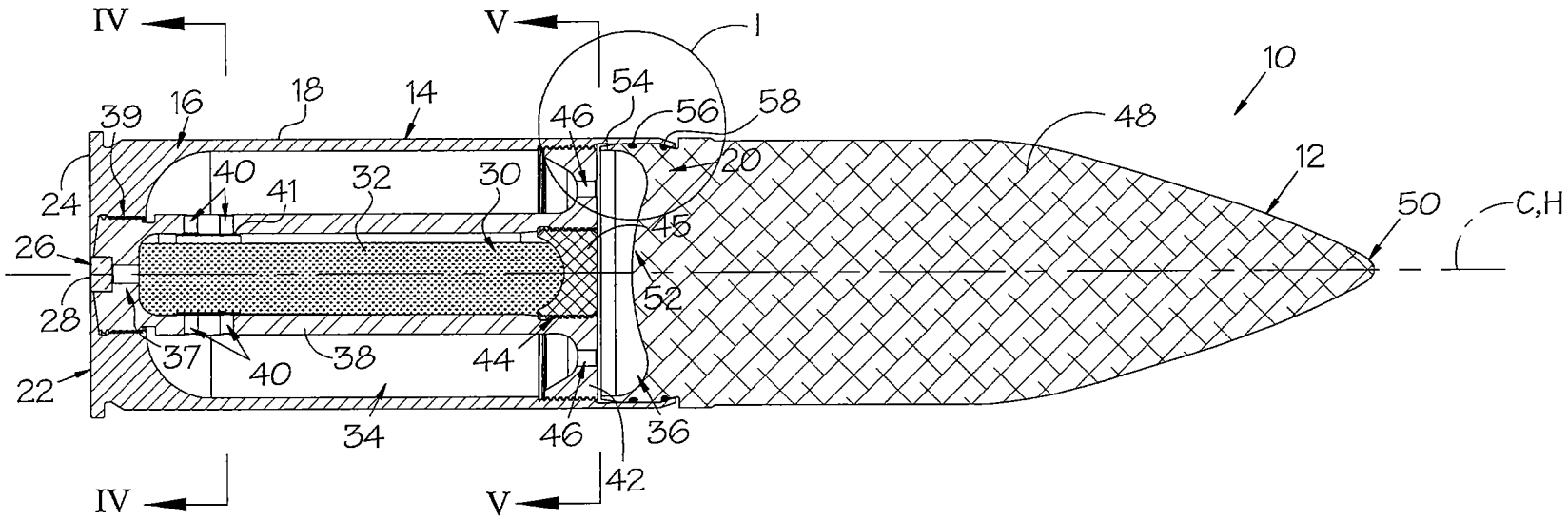
FIG. 3 shows a sectional side view of the cartridge ammunition of FIG. 1, sectioned along section line III-III of FIG. 2.
Figure 5:
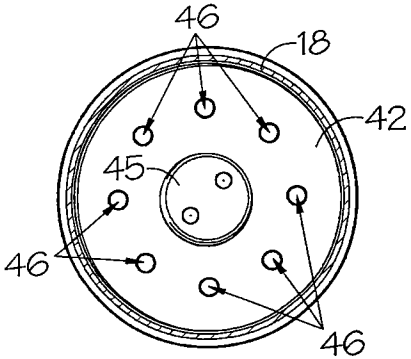
FIG. 5 shows a sectional end view of the cartridge ammunition of FIG. 1, sectioned along section line V-V of FIG. 3.
Figure 4:
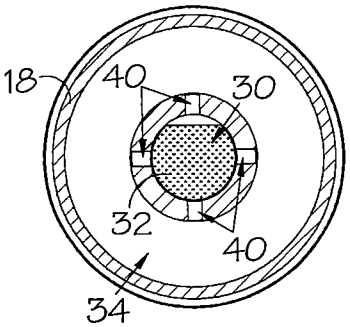
FIG. 4 shows a sectional end view of the cartridge ammunition of FIG. 1, sectioned along section line IV-IV of FIG. 3.
Figure 3A:
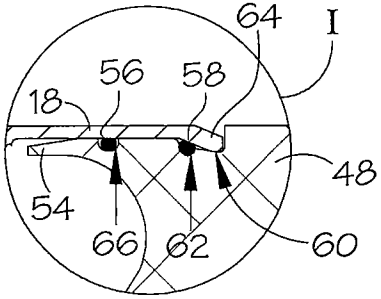
Figure 6:
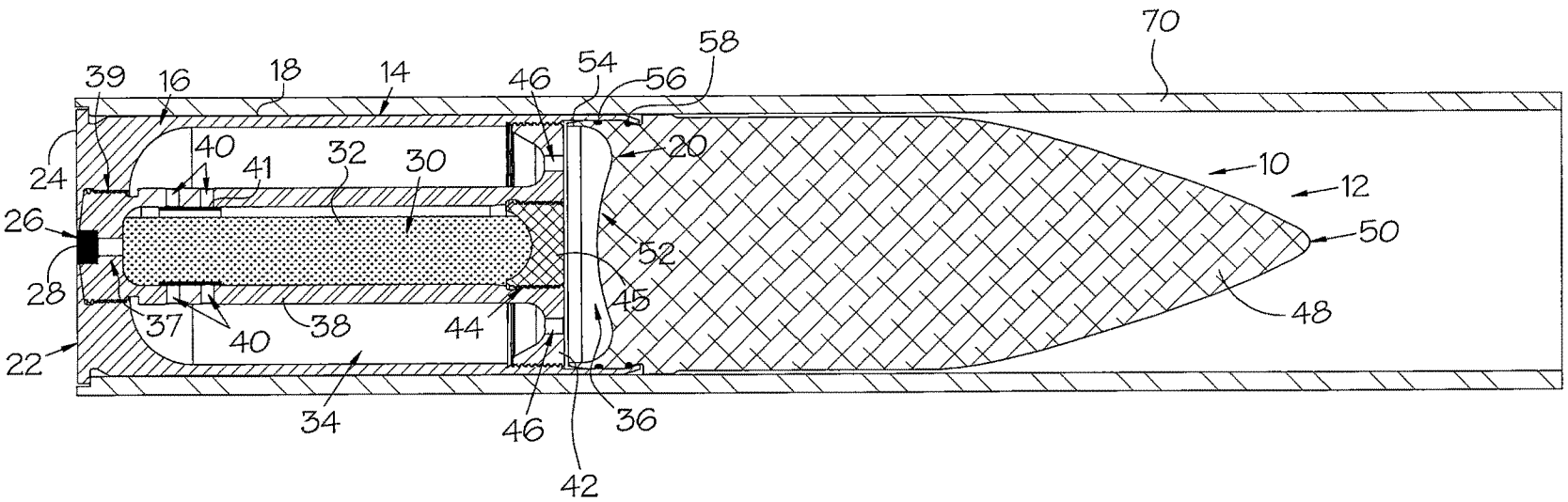
FIG. 6 shows a sectional side view of the cartridge ammunition of FIG. 1 located in a barrel of a firing weapon.

With reference to FIGS. 1 to 7 of the drawings, cartridge ammunition in accordance with the invention, is designated generally by the reference numeral 10. The cartridge ammunition is in the form of subsonic small to medium calibre ammunition having a high-pressure, low-pressure propulsion system for expelling the projectile from the cartridge. The cartridge ammunition 10 includes, broadly, a projectile 12 and a cartridge 14.

The cartridge 14 includes a cartridge case 16 having a cylindrical sidewall 18 having a front end 20 and a rear end 22. The front end 20 is open so as to receive the projectile 12 therein. The cartridge case has a base wall 24 which extends across the sidewall at its rear end.

A primer chamber 26 is located adjacent the base wall 24, in which an initiating primer 28 is held. The primer chamber is centrally located within the base wall of the cartridge and is configured to receive a firing pin of a firing weapon which extends into the primer chamber for detonating the primer. A portion 26 of the base wall 24 provides a deformable cover for closing off of a rear end of the primer chamber.

The cartridge further includes a high pressure chamber 30 for holding a propellant charge 32, an intermediate pressure chamber 34 for receiving expanding propellant gases from the high pressure chamber, and a low pressure chamber 36 adjacent the projectile for receiving expanding propellant gases from the intermediate pressure chamber.

The high pressure chamber 30 has an elongate cylindrical configuration and is centrally located within the cartridge case. More specifically, the high pressure chamber defines a longitudinal chamber axis H which coincides with a longitudinal cartridge axis C defined by the cartridge case which extends along a centre line of the cartridge case between its front and rear ends.

The intermediate pressure chamber 34 has an annular configuration wherein the intermediate pressure chamber surrounds the high pressure chamber when viewed in cross-section. More specifically, the cartridge includes a high pressure chamber body insert 38 which defines a boundary between the high pressure chamber and the intermediate pressure chamber. The high pressure chamber body insert has a hollow cylindrical configuration with a distal end thereof being open. The base wall 24 of the cartridge case has a central, internally screw-threaded socket 39 into which an externally screw-threaded proximal end of the high pressure chamber body insert is screwed in a manner forming a gas-tight seal with the cartridge case. The high pressure chamber body insert defines the primer chamber 26 and a passage 37 extending between the primer chamber and the high pressure chamber 30.

The high pressure chamber body insert 38 defines circumferentially equi-spaced high pressure venting holes 40 which extend between the high pressure and intermediate pressure chambers for allowing for venting propellant gases from the high pressure chamber to the intermediate pressure chamber. The cartridge ammunition includes rupturable burst diaphragms 41 which cover the high pressure venting holes. The number and configuration of the venting holes is determined by the type and specification of the ammunition.

The high pressure chamber body insert 38 defines a radially-extending annular flange 42 which defines a boundary between the intermediate and low pressure chambers. More specifically, the flange 42 has a cylindrical outer edge 44 which defines an external screw-thread formation which is screw-threadingly engaged with a complementary internal screw-thread formation of the sidewall of the cartridge case so as to form a gas-tight seal with the cartridge case. The high pressure chamber body insert 38 defines an internal screw-thread formation at the distal end of the insert into which an externally screw-threaded distal end of the high pressure chamber body is screwed in a manner forming a gas-tight seal with the low pressure chamber body insert.

The cartridge ammunition includes a cap insert 45 which sealingly closes off the distal end of the high pressure chamber body insert and defines a boundary between the high pressure chamber and the low pressure chamber. The cap insert has a cylindrical outer edge defining an external screw thread which is screw-threadingly engaged with the internal screw thread formation of the high pressure chamber body insert 38 so as to form a gas-tight seal.

The flange 42 defines a number of circumferentially spaced intermediate pressure venting holes 46 which extend between the intermediate pressure chamber and the low pressure chamber for venting of propellant gases from the intermediate pressure chamber to the low pressure chamber.

The projectile includes a projectile body 48 having a front end 50 and a rear end 52 which is sealingly located within the front end of the cartridge case. The projectile defines a circumferential skirt formation 54 at the rear end of the projectile body which projects rearwardly from the projectile body and which includes an O-ring seal 56 for forming a gas-tight seal with the sidewall of the cartridge case. In addition, the projectile body includes a second O-ring seal 58 which provides an additional gas-tight seal between the projectile and the cartridge case.

The projectile body 48 defines an annular recess 60 within which an annular groove 62 is defined which provides a seat for the O-ring seal 58. A front end region 64 of the cartridge case is crimped inwardly so as to engage the projectile body within the recess 60 thereby releasably holding the cartridge case in engagement with the projectile body. The skirt formation defines an annular groove 66 on an external side thereof, which provides a seat for the O-ring seal 56. The O-ring seals 56 and 58 are disposed parallel to one another and longitudinally spaced.

With reference to FIGS. 7*a* to 7*e* of the drawings, the cartridge ammunition 10 is shown located within a barrel 70 of a firing weapon. FIGS. 7*a* to 7*e* show, in sequence, the manner in which expanding propellant gases within the cartridge case of the cartridge ammunition, exert pressure on the projectile causing it to be expelled from the cartridge case.

Figure 7A:
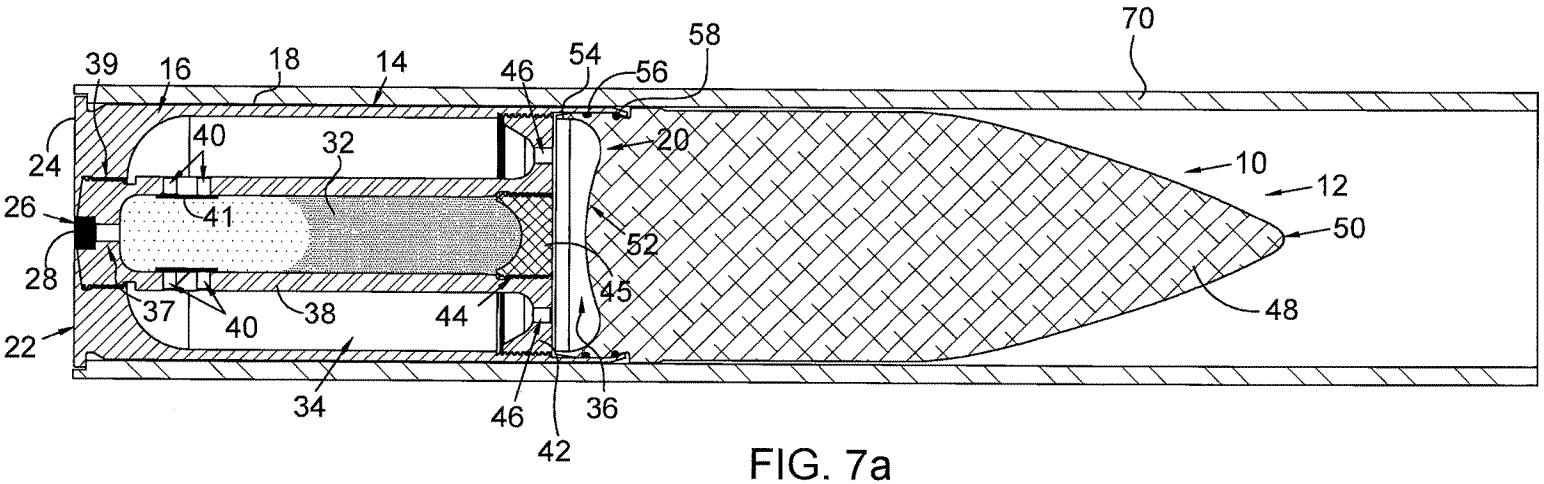
FIGS. 7*a* to 7*e* show, in sequence, the manner in which expanding propellant gases within the cartridge case of the cartridge ammunition of FIG. 1, exert pressure on the projectile thereof causing it to be expelled from the cartridge case.
Figure 7B:
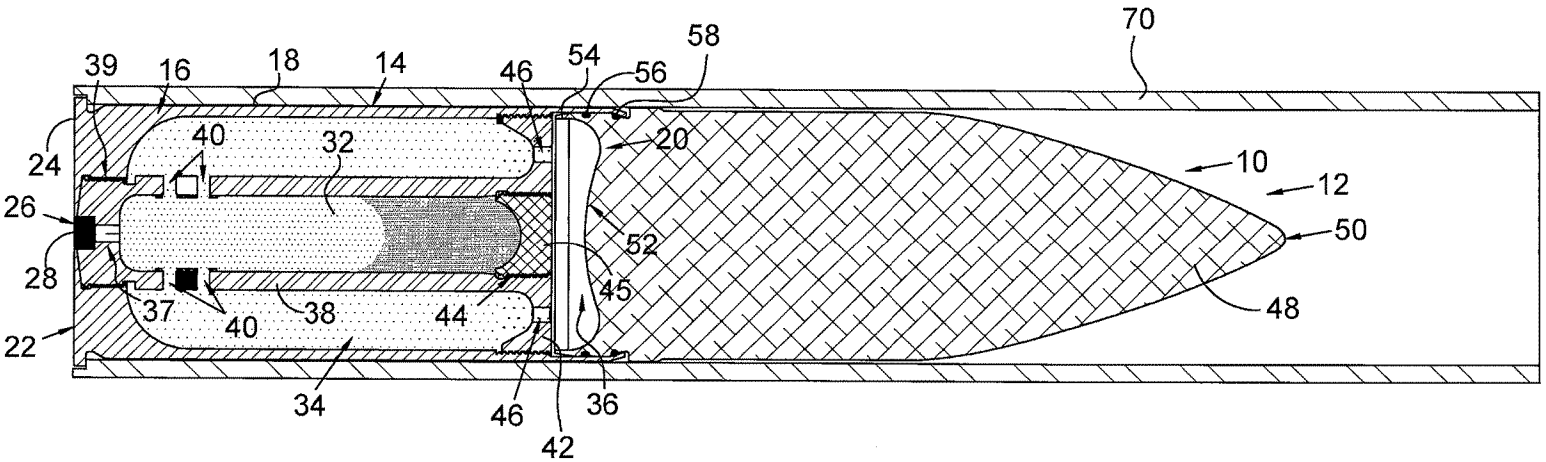
Figure 7C:
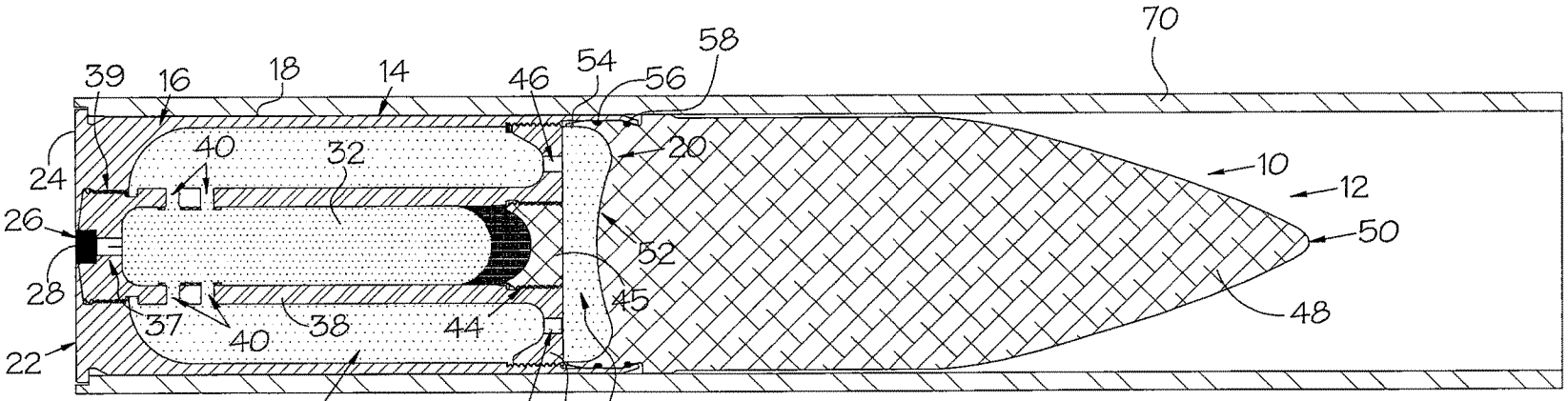
Figure 7D:
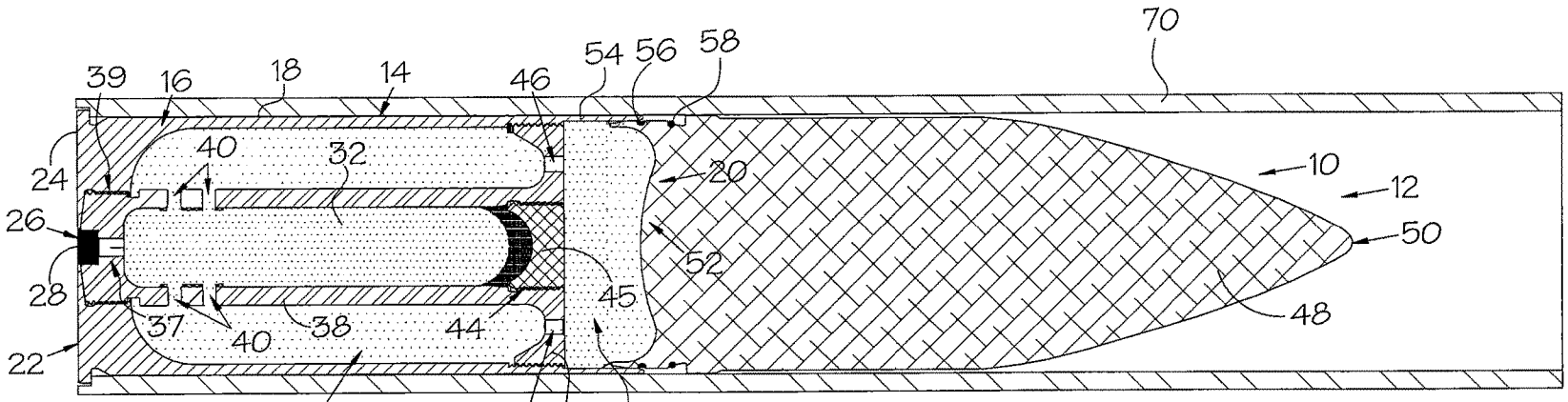
Figure 7E:
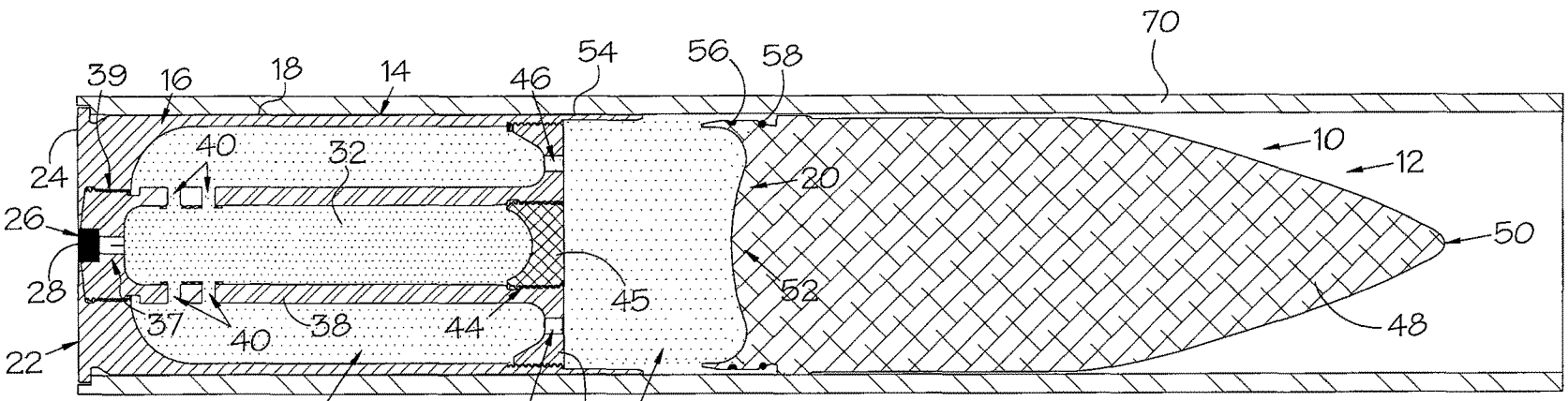

Upon high velocity deformation of the cover of the primer chamber by a pointed firing pin of the firing weapon, the primer charge spontaneously ignites, expelling a combustion pulse into the high pressure combustion chamber thereby initiating combustion of the propellant charge in the high pressure combustion chamber (see FIG. 7*a*). Upon initiation of the propellant charge, high pressure gases are generated which result in rupturing of the burst membranes covering the high pressure venting holes 40 (see FIG. 7*b*) allowing for venting of propellant gases from the high pressure chamber to the intermediate pressure chamber 34 via the high pressure vent holes. As the propellant gases expand into the intermediate pressure chamber 34, the propellant gases also expand and vent into the low pressure chamber 36 via the intermediate pressure venting holes 46. The expansion of the propellant gases causes a gradual gas pressure increase within the low pressure chamber 36 (see FIG. 7*c*). Pressure in the low pressure chamber continues to build to a point where the combined pressure within the intermediate pressure chamber and low pressure chamber is at such a magnitude that the inwardly deformed front end of the cartridge case opens (see FIG. 7*d*) thereby releasing the projectile which is accelerated out of the cartridge case and propelled along the length of the barrel (see FIG. 7*e*).

It will be appreciated that as the projectile moves, the low pressure chamber 36 increases in volume. Gas pressure in the intermediate pressure chamber continues to vent through the low pressure venting holes thereby controlling and attenuating the relatively higher pressure gases within the intermediate pressure chamber. This results in pressure within the intermediate pressure chamber being retained for longer. As a consequence of the attenuation of the gas pressure within the pressure chambers, the Applicant has found that the cartridge case does not expand to achieve full contact with the internal surface of the barrel of the firing weapon. The weapon chamber of the firing weapon is thus not exposed to relatively high firing pressures when subsonic ammunition having performance enhancements, is fired by the weapon.

The Applicant has found that the cartridge ammunition has a number of advantages in that the propellant charge is almost entirely combusted with little or no remaining residue. Provision of the three pressure chambers provides for controlled pressure release into the low pressure chamber providing a high level of control over gas pressure which results in consistent muzzle velocities. In addition, the Applicant has found that the efficient combustion of the propellant charge within the pressure chambers, results in a relatively low thermal signature and a significant reduction in muzzle flash from the firing weapon. Furthermore, the Applicant that the acoustic signature from the firing weapon is substantially reduced when utilising cartridge ammunition in accordance with the invention as a result of internal buffering which occurs in the intermediate pressure chamber.

In field trials conducted with the cartridge ammunition in accordance with the invention, the Applicant has noted that peak gas pressures are generated when the ammunition is fired within 50 to 70 microseconds after firing and thereafter begin to dissipate within 10 to 15 microseconds. The extended rear skirt formation of the projectile ensures that the sealing points provided by the O-ring seals 44 and 46 of the projectile clear the cartridge case only after the peak pressure has begun to dissipate. In addition, the free volume defined within the low pressure chamber adjacent a rear end of the projectile increases in volume as the projectile moves out of the cartridge thereby resulting in attenuation of peak gas pressures within the cartridge. As a result, the weapon chamber of the firing weapon is not exposed directly to the high pressure peaks that are evident when firing conventional subsonic ammunition.

In order to achieve the pressure attenuation advantages of the cartridge ammunition, the cartridge case has a structural rigidity and strength such that it will be able to withstand the internal peak pressures within the cartridge without failure or expanding to a full contact condition with the walls of the weapon chamber which would result in the same peak forces being transferred to the weapon chamber and barrel assembly. The cartridge case thus acts in a manner wherein it becomes a substitute for the barrel during the first phase of movement of the projectile relative to the cartridge case wherein the projectile remains within sealing engagement with the cartridge case and there is a closed retention of pressure within the cartridge case.

The invention claimed is:

1. A cartridge ammunition including:

a projectile; and a cartridge including:

a) a cartridge case having a cylindrical sidewall having an open front end to which the projectile is attached and a base wall extending across the sidewall at a rear end of the cartridge case;

b) a primer chamber adjacent the base wall in which an initiating primer is held and into which a firing pin of a firing weapon extends for initiating the primer;

c) a high pressure chamber for holding a propellant charge, which is adjacent to and in communication with the primer chamber;

d) an intermediate pressure chamber for receiving expanding propellant gases from the high pressure chamber; and e) a low pressure chamber at an operative rear end of the projectile, for receiving expanding propellant gases from the intermediate pressure chamber, the pressure chambers being delimited by walls within the cartridge case which define at least one high pressure venting hole for expanding propellant gases between the high pressure chamber and the intermediate pressure chamber and at least one intermediate pressure venting hole for expanding propellant gases between the intermediate pressure chamber and the low pressure chamber, the high pressure venting hole being covered by a rupturable burst membrane.

2. The cartridge ammunition as claimed in claim 1, wherein the high pressure chamber is centrally located within the cartridge case.

3. The cartridge ammunition as claimed in claim 1, wherein the intermediate pressure chamber has an annular configuration wherein the intermediate pressure chamber surrounds the high pressure chamber when viewed in cross section.

4. The cartridge ammunition as claimed in claim 1, wherein the high pressure chamber has an elongate cylindrical configuration wherein a longitudinal chamber axis defined by the high pressure chamber coincides with a longitudinal cartridge axis defined by the cartridge case which extends along a centre line of the cartridge case between its front and rear ends.

5. The cartridge ammunition as claimed in claim 1, wherein the cartridge includes a high pressure chamber body insert which defines a boundary between the high pressure chamber and the intermediate pressure chamber and which has a proximal screw thread formation which is sealingly screw-threadingly engaged with a complementary screw thread formation of the base wall of the cartridge case.

6. The cartridge ammunition as claimed in claim 5, wherein the high pressure chamber body insert has a hollow cylindrical configuration with a distal end thereof being open.

7. The cartridge ammunition as claimed in claim 6, wherein the high pressure chamber body insert includes a radially-extending annular flange which defines a boundary between the intermediate and low pressure chambers, the flange having a cylindrical outer edge defining an external screw thread formation which is screw-threadingly engaged with a complementary internal screw thread formation of the side wall of the cartridge case.

8. The cartridge ammunition as claimed in claim 7, which includes a cap insert which sealingly closes off the distal end of the high pressure chamber body insert and defines a boundary between the high pressure chamber and the low pressure chamber, the cap insert having a cylindrical outer edge defining an external screw thread formation which is screw-threadingly engaged with a complementary internal screw thread formation of the high pressure chamber body insert at the distal end thereof.

9. The cartridge ammunition as claimed in claim 5, wherein the high pressure chamber body insert defines a number of the high pressure venting holes which extend radially outwardly between the high pressure and intermediate pressure chambers allowing for venting of propellant gases from the high pressure chamber to the intermediate pressure chamber, each high pressure venting hole being covered by a rupturable burst membrane.

10. The cartridge ammunition as claimed in claim 7, wherein the flange of the high pressure chamber body insert defines a number of the intermediate pressure venting holes which extend between the intermediate pressure chamber and the low pressure chamber for venting of propellant gases from the intermediate pressure chamber to the low pressure chamber.

11. The cartridge ammunition as claimed in claim 1, wherein the projectile includes a projectile body having a front end and a rear end which is sealingly located within the front end of the cartridge case, the projectile defining a circumferential skirt formation at a rear end thereof which projects rearwardly from the projectile body and which includes sealing means for forming a gas-tight seal with the sidewall of the cartridge case.

12. The cartridge ammunition as claimed in claim 11, wherein the projectile includes an annular seal which extends circumferentially around the projectile for forming a gas-tight seal with the sidewall of the cartridge case.

13. The cartridge ammunition as claimed in claim 12, wherein the annular seal is located along an external side of the skirt formation of the projectile.

14. The cartridge ammunition as claimed in claim 13, wherein the external side of the skirt formation defines an annular groove providing a seat within which the annular seal is located.

15. The cartridge ammunition as claimed in claim 11, wherein the projectile includes an additional annular seal which extends circumferentially around the projectile body for forming an additional gas-tight seal with the sidewall of the cartridge case.

16. The cartridge ammunition as claimed in claim 15, wherein the additional annular seal is located along an external side of the projectile body at a location longitudinally spaced from the annular seal and parallel thereto.

17. The cartridge ammunition as claimed in claim 16, wherein the external side of the projectile body defines an annular groove defining a seat within which the additional annular seal is located.

18. The cartridge ammunition as claimed in claim 7, wherein the projectile body defines an annular recess into which a front end region of the cartridge case is crimped inwardly so as to engage the projectile body within the annular recess.

19. The cartridge ammunition as claimed in claim 8, wherein the annular groove for the additional annular seal is defined within the annular recess.

* * * * *